US011854462B1

(12) United States Patent
Tseng et al.

(10) Patent No.: US 11,854,462 B1
(45) Date of Patent: Dec. 26, 2023

(54) DISPLAY SYSTEM AND OPERATING METHOD THEREOF

(71) Applicant: AUO Corporation, Hsinchu (TW)

(72) Inventors: Ke-Hsin Tseng, Hsinchu (TW); Tsung-Hsuan Ho, Hsinchu (TW)

(73) Assignee: AUO Corporation, Hsinchu (TW)

( * ) Notice: Subject to any disclaimer, the term of this patent is extended or adjusted under 35 U.S.C. 154(b) by 0 days.

(21) Appl. No.: 18/084,544

(22) Filed: Dec. 20, 2022

(30) Foreign Application Priority Data

Oct. 17, 2022 (TW) ..... 111139188

(51) Int. Cl.
*G09G 3/20* (2006.01)

(52) U.S. Cl.
CPC ..... *G09G 3/2096* (2013.01); *G09G 2310/061* (2013.01); *G09G 2310/08* (2013.01); *G09G 2330/021* (2013.01)

(58) Field of Classification Search
None
See application file for complete search history.

(56) References Cited

U.S. PATENT DOCUMENTS

2011/0292024 A1* 12/2011 Baek ..... G09G 3/2096 345/212
2015/0255042 A1* 9/2015 Oh ..... G09G 3/20 345/212
2016/0372077 A1* 12/2016 Koo ..... G09G 3/2096
2020/0035144 A1* 1/2020 Ahn ..... G09G 3/2092

FOREIGN PATENT DOCUMENTS

TW 202020835 6/2020
TW 202042208 11/2020

* cited by examiner

*Primary Examiner* — Amare Mengistu
*Assistant Examiner* — Sarvesh J Nadkarni
(74) *Attorney, Agent, or Firm* — JCIPRNET

(57) ABSTRACT

A display system and an operating method thereof are provided. The display system includes a display panel, a source driver, and a timing controller. The source driver is coupled to the display panel for providing a plurality of pixel voltages to the display panel. The timing controller has a transmission interface circuit and is coupled to the source driver. The timing controller detects whether an operation timing of the display system enters a vertical blanking (VBK) period. When the operation timing of the display system enters the VBK period, the timing controller turns off the transmission interface circuit and causes the source driver to enter an idle mode. When the operation timing of the display system is at a preset time before an end of the VBK period, the timing controller turns on the transmission interface circuit and wakes up the source driver.

12 Claims, 3 Drawing Sheets

DISPLAY SYSTEM AND OPERATING METHOD THEREOF

CROSS-REFERENCE TO RELATED APPLICATION

This application claims the priority benefit of Taiwan application serial no. 111139188, filed on Oct. 17, 2022. The entirety of the above-mentioned patent application is hereby incorporated by reference herein and made a part of this specification.

BACKGROUND

Technical Field

The disclosure relates to a display system, and particularly relates to a display system and an operating method thereof.

DESCRIPTION OF RELATED ART

A variable refresh rate (VRR) panel can automatically and continuously adjust a frame refresh rate according to the content actually displayed, instead of using the frame refresh rate fixed at 90 Hertz (Hz) or 120 Hz like current mainstream mobile phones. Under the condition of a fixed frame refresh rate, even if static content (such as a picture) is displayed, the screen is refreshed at a fixed frequency, which increases power consumption. In terms of the technology of the VRR panel, the power consumption can be greatly reduced.

Correspondingly, Intel Corporation also proposed the technology of a low refresh rate (LRR) panel to control a display panel to operate at different refresh rates for power saving. The technology of the LRR panel requires the display panel to switch the frame refresh rate by changing a total vertical amount. That is to say, an active display time transmitted by the system end to the display panel remains unchanged, and merely a time duration of a vertical blanking (VBK) period is changed. As the frequency of the frame refresh rate decreases, the time duration of the VBK period in a frame period increases. Although the power consumption is reduced as the frequency of the frame refresh rate decreases, the control circuit driving the display panel still operates at the original frequency, which limits the power saving effect of the display system.

SUMMARY

The disclosure provides a display system and an operating method thereof, which can improve the power saving effect of the display system under a variable refresh rate (VRR).

The display system of the disclosure includes a display panel, a source driver, and a timing controller. The source driver is coupled to the display panel and configured to provide a plurality of pixel voltages to the display panel. The timing controller has a transmission interface circuit and is coupled to the source driver. The timing controller detects whether an operation timing of the display system enters a vertical blanking (VBK) period. In response to the operation timing of the display system entering the VBK period, the timing controller turns off the transmission interface circuit and causes the source driver to enter an idle mode. In response to the operation timing of the display system being at a preset time before an end of the VBK period, the timing controller turns on the transmission interface circuit and wakes up the source driver.

The operating method of the display system of the disclosure includes the following. Whether an operation timing of the display system enters a VBK period is detected via a timing controller of the display system. In response to the operation timing of the display system entering the VBK period, a transmission interface circuit in the timing controller is turned off via the timing controller to cause a source driver of the display system to enter an idle mode. In response to the operation timing of the display system being at a preset time before an end of the VBK period, the transmission interface circuit is turned on via the timing controller and the source driver is woken up.

Based on the above, in the display system and the operating method thereof according to the embodiment of the disclosure, during the VBK period, the transmission interface circuit is turned off through the timing controller, which causes the source driver to be idle (or dormant), thereby improving the power saving effect of the display system.

In order to make the above-mentioned features and advantages of the disclosure more comprehensible, the following embodiments are given and described in detail with the accompanying drawings as follows.

DESCRIPTION OF THE EMBODIMENTS

Unless otherwise defined, all terms (including technical and scientific terms) used herein have the same meaning as commonly understood by persons skilled in the art to which this disclosure belongs. It is to be further understood that such terms, as those defined in commonly used dictionaries, should be interpreted as having meanings consistent with the relevant art and the background or context of the disclosure, and should not be interpreted in an idealized or overly formal manner, unless specifically defined in the disclosure.

It is to be understood that, although the terms "first," "second," "third," etc. may be used herein to describe various elements, components, regions, layers, and/or sections, these elements, components, regions, layers, and/or sections shall not be limited by these terms. These terms are merely used to distinguish one element, component, region, layer, or section from another element, component, region, layer, or section. Therefore, "first element," "first component," "first region," "first layer," or "first section" mentioned below may be referred to as "second element," "second component," "second region," "second layer," or "second section" without departing from the teachings in the disclosure.

The terms used herein are only for describing particular embodiments and are not limiting. As used in the disclosure, unless specifically defined, the singular forms "a," "an" and "the" are intended to include the plural forms including "at least one"; and the term "or" means "and/or." As used in the disclosure, the term "and/or" includes any and all combinations of one or more of the associated listed items. Itis also to be understood that, when used in the disclosure, the terms "comprising" and/or "including" designate the presence of stated features, regions, integers, steps, operations, elements, and/or components, but do not exclude one or more of the presence, or addition, of other features, regions, integers, steps, operations, elements, components, and/or combinations thereof.

Figure 1:
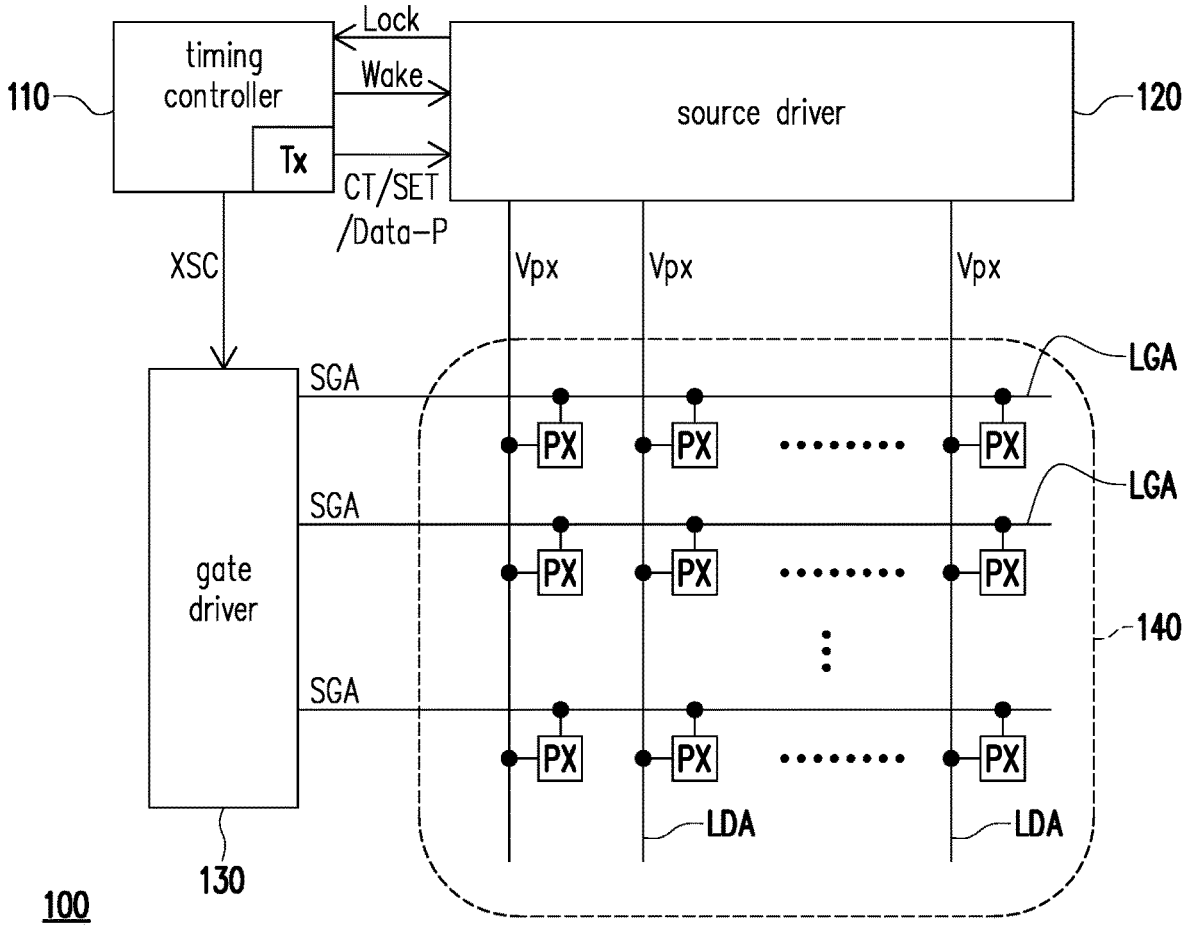
FIG. 1 is a system schematic diagram of a display system according to an embodiment of the disclosure.

FIG. 1 is a system schematic diagram of a display system according to an embodiment of the disclosure. Referring to FIG. 1, in the embodiment, a display system 100 at least includes a timing controller 110, a source driver 120, a gate driver 130 and a display panel 140. The gate driver 130 is coupled to the display panel 140 for providing a plurality of gate signals SGA sequentially enabled (e.g., at a high voltage level) to the display panel 140. The source driver 120 is coupled to the display panel 140 for providing a plurality of pixel voltages Vpx to the display panel 140. The timing controller 110 is coupled to the source driver 120 and the gate driver 130 and has a transmission interface circuit Tx.

The timing controller 110 outputs a wake-up signal Wake to the source driver 120 for controlling the source driver 120 to enter an idle mode or to wake up the source driver 120 from the idle mode. Also, the timing controller 110 receives a lock signal Lock from the source driver 120 to determine whether the source driver 120 is ready. Also, after the source driver 120 is ready, the timing controller 110 transmits data to the source driver 120 through the transmission interface circuit Tx.

Figure 2:
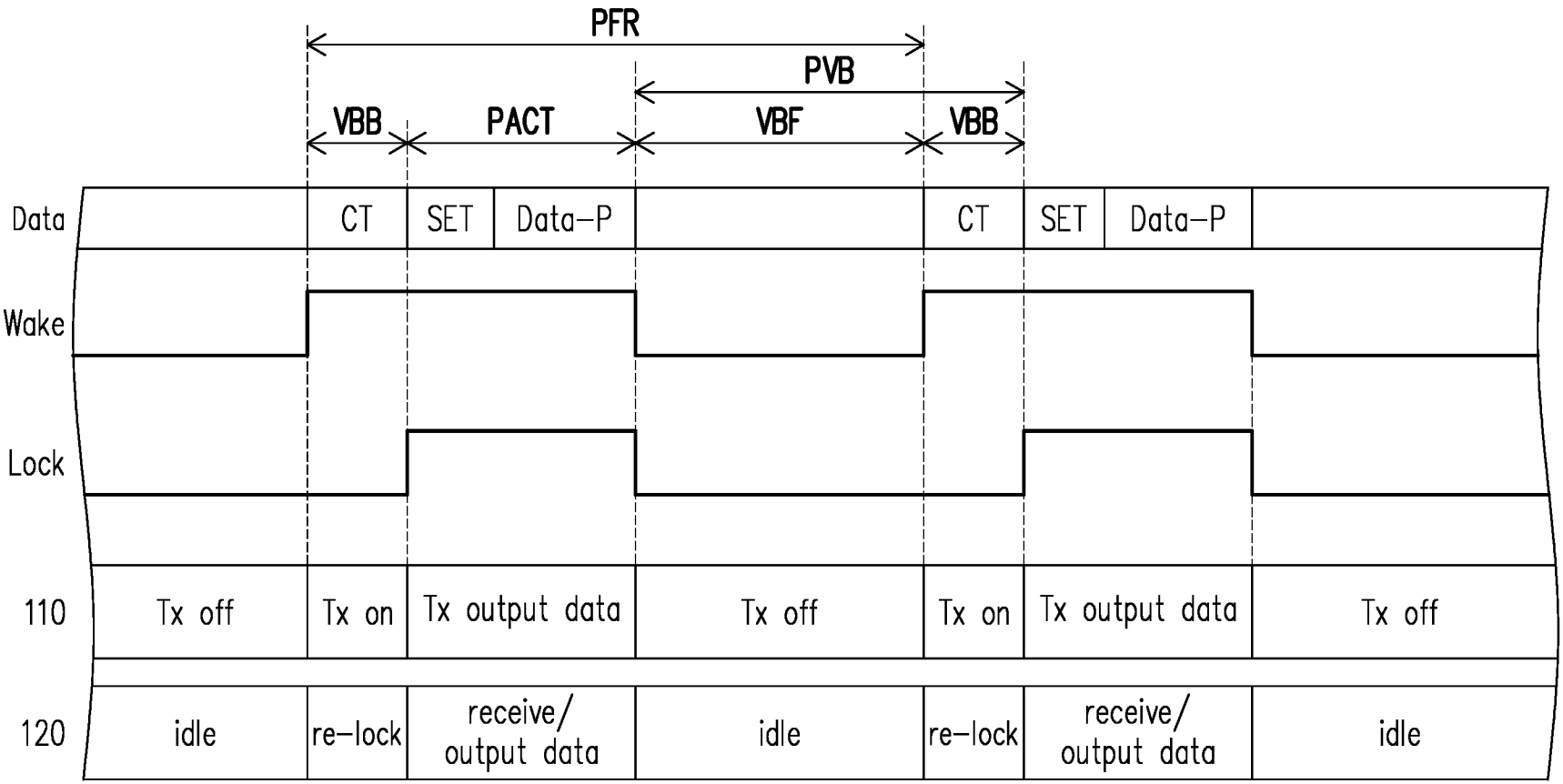
FIG. 2 is a schematic diagram of driving waveforms of a display system according to an embodiment of the disclosure.

Further, the timing controller 110 can detect whether an operation timing of the display system 100 enters a vertical blanking (VBK) period (PVB as shown in FIG. 2). The timing controller 110 can determine the operation timing of the display system 100 through a vertical synchronization (V-sync) signal or a similar signal and a counter during a horizontal scanning period. Next, when the operation timing of the display system 100 enters the VBK period, the timing controller 110 turns off the transmission interface circuit Tx and causes the source driver 120 to enter the idle mode; when the operation timing of the display system 100 is at a preset time (e.g., entering a back porch period of the VBK period) before an end of the VBK period, the timing controller 110 can turn on the transmission interface circuit Tx and wake up the source driver 120. In this way, through the transmission interface circuit Tx and the source driver 120 entering idle (or dormant) or waking up, the power saving effect of the display system 100 can be improved.

In the embodiment, the timing controller 110 can transmit a plurality of control signals XSC to the gate driver 130 to control a timing of the gate driver 130 outputting the gate signal SGA.

In the embodiment, the display panel 140 includes a plurality of pixels PX, a plurality of gate lines LGA, and a plurality of data lines LDA. The pixels PX are arranged, for example, in an array; the gate lines LGA are coupled to the gate driver 130 and are configured, for example, in parallel along a vertical direction of the drawing; and the data lines LDA are coupled to the source driver 120 and are configured, for example, in parallel along a horizontal direction of the drawing. The pixels PX are individually coupled to one of the gate lines LGA to receive a corresponding gate signal SGA via the gate line LGA, and are coupled to one of the data lines LDA to receive a corresponding pixel voltage Vpx via the data line LDA.

In the embodiment, the transmission interface circuit Tx may be a differential signal output circuit, but the embodiment of the disclosure is not limited thereto.

FIG. 2 is a schematic diagram of driving waveforms of a display system according to an embodiment of the disclosure. Referring to FIG. 1 and FIG. 2, in the embodiment, a single frame period PFR at least includes an active display period PACT and a VBK period PVB. The VBK period PVB can be divided into at least a front porch period VBF and a back porch period VBB.

A single VBK period PVB may be formed by concatenating the front porch period VBF of a current frame period PFR and the back porch period VBB of a next frame period PFR.

When entering the VBK period PVB, the timing controller 110 directly turns off the transmission interface circuit Tx to stop data transmission (i.e., a data field is blank) and sets the wake-up signal Wake to a disabled level (e.g., a low voltage level) to cause the source driver 120 to enter the idle mode. When entering the idle mode, the source driver 120 sets the lock signal Lock to the disabled level to inform the timing controller 110 that a timing needs to be re-locked.

When entering the preset time before the end of the VBK period PVB (the back porch period VBB is taken as an example here), the timing controller 110 can directly turn on the transmission interface circuit Tx, and the timing controller 110 sets the wake-up signal Wake to an enabled level (e.g., a high voltage level) to wake up the source driver 120.

When the timing controller 110 turns on the transmission interface circuit Tx, the transmission interface circuit Tx outputs a training code CT to the source driver 120, and the source driver 120 re-locks a transmission timing for transmitting data by the transmission interface circuit Tx based on the training code CT. When the source driver 120 locks the transmission timing based on the training code CT, the lock signal Lock provided to the timing controller 110 is set to the enabled level, indicating that data can be received and data can be output.

When the lock signal Lock is at the enabled level, the timing controller 110 sequentially transmits a setting parameter SET and display data Data-P to the source driver 120 through the transmission interface circuit Tx during the active display period PACT. The source driver 120 sets an operating state thereof based on the setting parameter SET and provides the plurality of pixel voltages Vpx based on the display data Data-P.

In the embodiment, the preset time before the end of the VBK period PVB takes the back porch period VBB as an example, but in the embodiment of the disclosure, the preset time can be a horizontal scanning period of any number, which is determined according to a circuit design, and the embodiment of the disclosure is not limited thereto.

Figure 3:
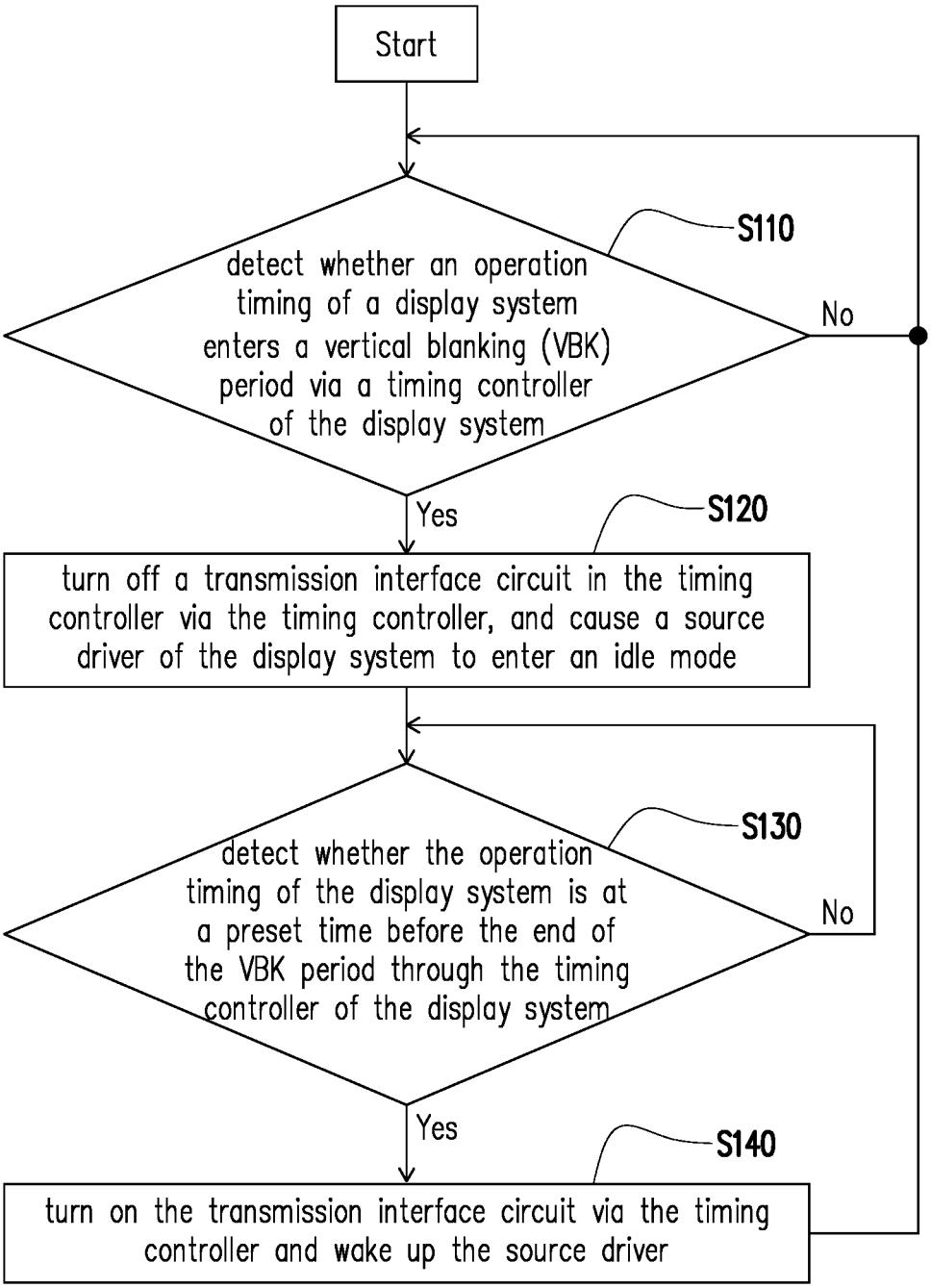
FIG. 3 is a flowchart of an operating method of a display system according to an embodiment of the disclosure.

FIG. 3 is a flowchart of an operating method of a display system according to an embodiment of the disclosure. Referring to FIG. 3, in the embodiment, the operating method of the display system includes the following. In Step S110, whether an operation timing of the display system enters a VBK period is detected via a timing controller of the display system.

When the operation timing of the display system does not enter the VBK period, that is, a determined result of Step S110 is "No," the flow returns to Step S110, when the operation timing of the display system is about to enter the VBK period, that is, the determined result of Step S110 is "Yes," the flow enters Step S120.

In Step S120, a transmission interface circuit in the timing controller is turned off via the timing controller, which causes a source driver of the display system to enter an idle mode. In Step S130, whether the operation timing of the display system is at a preset time before an end of a VBK period is detected through the timing controller of the display system. When the operation timing of the display system is not at the preset time before the end of the VBK period, that is, the determined result of Step S130 is "No," the flow returns to Step S130, when the operation timing of the display system is at the preset time before the end of the VBK period, that is, the determined result of Step S130 is "Yes," the flow enters Step S140.

In Step S140, the transmission interface circuit is turned on via the timing controller and the source driver is woken up. A sequence of Step S110, Step S120, Step S130, and Step S140 is for illustration, and the embodiment of the disclosure is not limited thereto. Also, details of Step S110, Step S120, Step S130, and Step S140 may be described with reference to the embodiments of FIG. 1 and FIG. 2, and will not be repeated here.

In summary of the above, in the display system and the operating method thereof according to the embodiment of the disclosure, during the VBK period, the transmission interface circuit is turned off through the timing controller, which causes the source driver to be idle (or dormant), thereby improving the power saving effect of the display system.

Although the disclosure has been disclosed above by the embodiments, they are not intended to limit the disclosure. Persons skilled in the art to which this disclosure belongs can make some changes and modifications without departing from the spirit and scope of the disclosure. Therefore, the protection scope of the disclosure shall be determined by the scope of the appended claims.

What is claimed is:

1. A display system, comprising:

a display panel;

a source driver coupled to the display panel and configured to provide a plurality of pixel voltages to the display panel; and a timing controller comprising a transmission interface circuit and coupled to the source driver, wherein, the timing controller detects whether an operation timing of the display system enters a vertical blanking (VBK) period;

in response to the operation timing of the display system entering the VBK period, the timing controller turns off the transmission interface circuit and causes the source driver to enter an idle mode; and in response to the operation timing of the display system being at a preset time before an end of the VBK period, the timing controller turns on the transmission interface circuit and wakes up the source driver.

2. The display system of claim 1, wherein, in response to the timing controller turning on the transmission interface circuit, the transmission interface circuit outputs a training code to the source driver; and in response to the source driver locking a transmission timing based on the training code, a lock signal is set to an enabled level, wherein the lock signal is provided to the timing controller.

3. The display system of claim 2, wherein, in response to the lock signal being at the enabled level, the timing controller sequentially transmits a setting parameter and display data to the source driver through the transmission interface circuit, and the source driver provides the plurality of pixel voltages based on the display data.

4. The display system of claim 3, wherein, during the VBK period, the lock signal is set to a disabled level.

5. The display system of claim 1, wherein, the timing controller outputs a wake-up signal to the source driver, and sets the wake-up signal to an enabled level to wake up the source driver.

6. The display system of claim 5, wherein, during the VBK period, the wake-up signal is set to a disabled level to cause the source driver to enter the idle mode.

7. An operating method of a display system, comprising:

detecting whether an operation timing of the display system enters a VBK period via a timing controller of the display system;

turning off a transmission interface circuit in the timing controller via the timing controller and causing a source driver of the display system to enter an idle mode in response to the operation timing of the display system entering the VBK period; and turning on the transmission interface circuit via the timing controller and waking up the source driver in response to the operation timing of the display system being at a preset time before an end of the VBK period.

8. The operating method of claim 7, further comprising:

outputting a training code to the source driver via the transmission interface circuit in response to the timing controller turning on the transmission interface circuit; and setting a lock signal to an enabled level via the source driver in response to the source driver locking a transmission timing based on the training code, wherein the lock signal is provided to the timing controller.

9. The operating method of claim 8, further comprising:

transmitting sequentially a setting parameter and display data to the source driver through the transmission interface circuit via the timing controller in response to the lock signal being at the enabled level, wherein, the source driver provides a plurality of pixel voltages to a display panel of the display system based on the display data.

10. The operating method of claim 8, further comprising:

setting the lock signal to a disabled level via the source driver during the VBK period.

11. The operating method of claim 7, further comprising:

outputting a wake-up signal to the source driver via the timing controller; and setting the wake-up signal to an enabled level via the timing controller to wake up the source driver.

12. The operating method of claim 11, further comprising:

setting the wake-up signal to a disabled level via the timing controller to cause the source driver to enter the idle mode during the VBK period.

* * * * *